US008025705B2

(12) United States Patent
Holle et al.

(10) Patent No.: US 8,025,705 B2
(45) Date of Patent: Sep. 27, 2011

(54) SIMULTANEOUS GASIFICATION OF COALS OF WIDELY DIFFERING DEGREES OF COALIFICATION IN ENTRAINED FLOW GASIFICATION

(75) Inventors: Bernd Holle, Freiberg (DE); Volker Kirchhübel, Freiberg (DE); Joachim Lamp, Halsbrücke (DE); Manfred Schingnitz, Freiberg (DE); Günter Tietze, Freiberg (DE)

(73) Assignee: Siemens Aktiengesellschaft, Munich (DE)

( * ) Notice: Subject to any disclaimer, the term of this patent is extended or adjusted under 35 U.S.C. 154(b) by 518 days.

(21) Appl. No.: 12/220,132

(22) Filed: Jul. 22, 2008

(65) Prior Publication Data

US 2009/0025294 A1 Jan. 29, 2009

(30) Foreign Application Priority Data

Jul. 24, 2007 (DE) ..... 10 2007 034 524

(51) Int. Cl.
*C10J 3/00* (2006.01)

(52) U.S. Cl. ..... 48/210; 48/76; 48/77; 48/61; 48/203; 252/373

(58) Field of Classification Search ..... 48/203, 48/204, 209, 197 R; 202/150, 232, 235; 122/5; 585/242, 240

See application file for complete search history.

(56) References Cited

U.S. PATENT DOCUMENTS

| | | | | |
|---|---|---|---|---|
| 4,265,868 | A * | 5/1981 | Kamody | 423/418.2 |
| 4,887,722 | A * | 12/1989 | Greenward, Sr. | 209/3 |
| 5,132,007 | A * | 7/1992 | Meyer et al. | 208/427 |
| 6,664,302 | B2 * | 12/2003 | French et al. | 518/700 |

FOREIGN PATENT DOCUMENTS

| | | | |
|---|---|---|---|
| CN | 2700718 | Y | 5/2005 |
| DE | 35 34 015 | A1 | 4/1986 |
| DE | 10 2005 047 583 | A1 | 4/2007 |
| EP | 0 677 567 | B1 | 10/1995 |

OTHER PUBLICATIONS

Jürgen Carl; Noell-Konversionsverfahren zur Verwertung und Entsorgung von Abfällen; pp. 33 and 73; EF-Verlag für Energie- und Umwelttechnik GmbH; ISBN 3-924511-82-9; first publishing in Germany.

H.-D. Schilling and H. Schreckenberg; "Kohlevergasung in der Energietechnik"; Publushing House: Verlag Glückauf 1979; VGB Technische Vereinigung der Grosskraftwerksbetreiber e. V.; Description: Entwicklung eines Kombi-Prozesses auf der Basis der Wirbelschichtfeuerung; pp. 82-99; Germany.

* cited by examiner

*Primary Examiner* — Kaity V. Handal

(57) ABSTRACT

A method for gasification of fuel in an entrained flow of a gasification reactor. The method includes jointly gasifying a mixture of at least two different fuels having different degrees of coalification, including those of differing coal qualities such as brown coals and stone coals. The method also includes pulverizing the coals forming the mixture in specific grain bands and drying the coals forming the mixture to a specific residual water content.

9 Claims, 1 Drawing Sheet

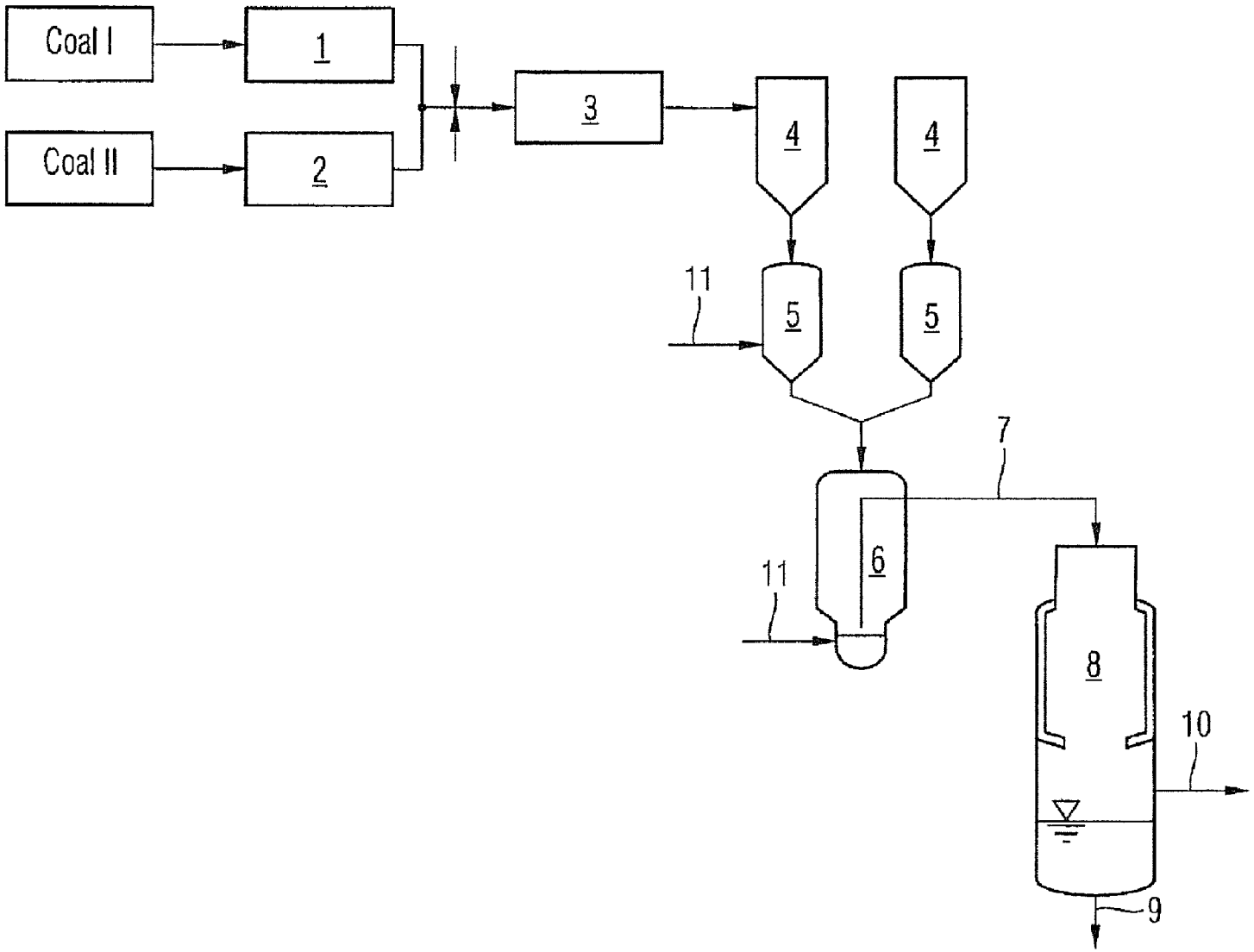
Coal I
Coal II
1
2
3
4
4
5
5
6
7
8
9
10
11
11

SIMULTANEOUS GASIFICATION OF COALS OF WIDELY DIFFERING DEGREES OF COALIFICATION IN ENTRAINED FLOW GASIFICATION

CROSS REFERENCE TO RELATED APPLICATIONS

This application claims priority of German application No. 10 2007 034 524.2 filed Jul. 24, 2007, which is incorporated by reference herein in its entirety.

FIELD OF THE INVENTION

The invention relates to a method for simultaneous gasification of coals of widely differing degrees of coalification, such as brown coals and stone coals, in accordance with the method of entrained flow gasification. The invention allows coals pulverized into pulverized fuel to be converted into synthesis gases in a gasification plant with oxygen or with a gasification means mixture containing free oxygen in the entrained flow.

BACKGROUND OF THE INVENTION

In such cases there is a specific relationship between the degree of coalification of the coals and the volatile component content and the surface structure. Less coalified coals possess a larger content of volatiles as well as a larger internal surface as a result of the pore structure. They are thus more reactive than strongly coalified coals. This characteristic is especially marked between brown coals and stone coals, but also within the stone coals if anthracite is regarded as the most coalified coal and high-volatile coal as the least coalified coal.

For this reason for example brown coals and stone coals are not jointly gasified in accordance with the prior art. The technique of synthesis gas generation in accordance with the method of autothermic entrained flow gasification has been known for many years and is described in detail in H.-D. Schilling "Kohlevergasung (coal gasification)", Verlag Glückauf 1979 as well as J. Carl et al. "Noell-Konversionsverfahen (Noell conversion process)", EF-Verlag für Energie and Umwelttechnik GmbH, 1996, Page 33 and 73. Different embodiments of reactors are further shown in EP0677567B1 and DE3534015A1. With a dry pneumatic feed of the pulverized fuel to the gasification reactor in accordance with patent of application number: 10 200 5 047 583.3 such as CN 200 4200 200 7.1 eddying of the pulverized fuel in a dispensing vessel puts it into a fluid state and it is fed by application of a drop in pressure via a pipeline from the eddy layer of the dispensing vessel to the burner of the gasification reactor. The different densities of brown coal and stone coal also mean that their eddy and flow properties are different. To enable these different coals to be conveyed together, specific ranges of grain size of the coals are required.

SUMMARY OF THE INVENTION

Using this prior art as its starting point, the object of the invention is to create a gasification method in which, with a reliable and safe mode of operation, the simultaneous gasification of coals of different degrees of coalification such as brown coals and stone coals is allowed, with the pulverized fuel, consisting of a mixture of the different coals, being fed from a common dispensing system to the gasification reactor.

This object is achieved by the gasification method as claimed in the features of the independent claim.

The coals forming the mixture are thus, to achieve the same speed of conversion, pulverized in the specific specified grain bands, and depending on their degree of coalification, dried to the specific given residual water content.

Subclaims reflect advantageous embodiments of the invention.

The feeding of the pulverized fuel consisting of coals of differing degrees of coalification is achieved as follows:

Because of their different characteristics, the coals of different degrees of coalification are brought to the corresponding water contents and ranges of granulation in separate drying and pulverizing systems

| Fuels | | Grain size distribution | Moisture content |
|---|---|---|---|
| Petrol coke<br>Anthracite<br>Stone coal | (low reactivity $V^{daf} \leqq 18\%$) | 50% < 63 μm<br>95Ma % < 200 μm | <2 wt. % |
| Pyrolysis coke | | ≧99% < 250 μm<br>98% < 500 μm | <2 wt. % |
| Stone coal | | ≧94% < 250 μm<br>98% < 500 μm | <2 wt. % |
| Hard brown coal | | ≧94% < 250 μm<br>98% < 500 μm | <8 wt. % |
| Soft brown coal | | ≧55% < 100 μm<br>≧97% < 500 μm | <12 wt. % |

The lumps of coal dried and pulverized into dust according to the given specifications are mixed in a separate device and discharged to an operational bunker for storage, from the operational bunker pressure sluices are alternately filled with the pulverized fuel mixture and pressurized with an inert gas, such as nitrogen, at operating pressure for example, the pulverized fuel mixture under operating pressure is periodically discharged from the pressure sluices to a dispensing vessel, by feeding in an eddying and conveyor gas a thick eddy layer is created in the dispensing vessel, from which the pulverized fuel mixture is fed to the burner of the gasification reactor, by simultaneous feeding in of a gasification means containing free oxygen the pulverized fuel mixture is converted in the gasification reactor into raw synthesis gas.

BRIEF DESCRIPTION OF THE DRAWINGS

The invention is explained below in more detail by one FIGURE and two exemplary embodiments. FIGURE shows a block diagram of the technology.

DETAILED DESCRIPTION OF THE INVENTION

Example 1

A gasification plant is to be set up for an output of 500 MW gross. There is provision for using a mixture of stone coal dust and brown coal dust as fuel. The two coal types are supplied as raw coal and must first be dried and pulverized into coal dust for example. The brown coal is a soft brown coal with a water content of 55% and an ash content of 8% wf as well as a calorific value of 20500 KJ/kg waf the stone coal possesses a water content of 8% as well as an ash content of 12% wf and a calorific value of 29500 KJ/kg waf. The brown coal and the stone coal given in the example are designated coal I and coal II. Because of their different water content and behavior when pulverized, different pulverizing and drying technologies are necessary.

Brown coal I is dried in a drying and pulverizing plant to a residual water content <12 Ma % and crushed to the grain size ≧55 Ma % 100 μm as well as ≧97 Ma % <500 μm into pulverized fuel.

The stone coal II is a low-volatiles, slow-reaction coal with a with a volatile component content ≦18 Ma % waf which is dried to a water content <2 Ma % and brought to a grain band of 50 Ma %<63 μm as well as 95 Ma %<200 μm in the drying and pulverizing unit 2. Because of their specific grain band and water content both coals can be fed separately or mixed pneumatically according to the principle of high density pneumatic conveying to the gasification reactor. With joint gasification the pulverized fuel flows from the pulverizing and drying units 1 and 2 are fed to a mixing unit 3 in order to achieve as homogeneous a mixture as possible. Then the pulverized mixture reaches the operational bunker 4, from which the pressure sluices 5 are filled alternately and are pressurized by an inert gas to operational pressure. The dust under operational pressure is in its turn discharged by a gravity conveyor alternately to a dispensing vessel 6. The emptied sluice 5 is depressurized, filled once again with fuel from the operational bunker 4, pressurized and can convey its pulverized content into the dispensing vessel 6 once again. Between one and four pressure sluices 5 can be connected to the dispensing vessel 6, depending on the output. In this example four pressure sluices 5 are needed. The arrangement of a number of pressure sluices 5 allows a continuous operation of the dispensing vessel 6 to be achieved from the discontinuous operation of the pressure sluice 5. The dispensing vessel 6 has a narrowed area in the lower part in which a fluidized bed ground is employed. By feeding in inert gas 11 a dense fluid layer comprising a pulverized fuel-inert gas suspension is formed above the fluidized bed ground, into which the conveyor lines extend and transport the fuel to the gasification reactor 8 where it is converted with a gasification means containing free oxygen into raw synthesis gas. One or more conveyor lines 7 can be used. The raw synthesis gas travels via the line 10 into downstream cleaning systems. The ash component of the coals converted into granulated slag during the gasification process is removed from the gasification reactor via the line 9.

Example 2

A gasification plant with the output of example 1 is operated simultaneously with a mixture of a slow-reaction stone coal in accordance with example 1 and a reaction-friendly coal with a volatile component content >18 Ma % waf. The reaction-friendly stone coal is likewise dried to a water content <2 Ma %, the required grain size range is produced from 94 Ma % <250 μm and 98 Ma % <500 μm.

Petrol coke and anthracite behave like the low-volatility stone coals. When hard brown coal is used it must be dried to a residual water content <8 Ma %, the grain distribution of the pulverized fuel created is produced at >94 Ma % <250 μm and 98 Ma % <500 μm. The different pulverized fuels of coals I and II can also be produced externally and fed jointly to the mixing station 3.

Inventive objects are also produced by the following combinations of features.

A method for gasification of pulverized fuels in an entrained flow gasification reactor at pressures between normal pressure and 80 bar, at temperatures between 1200-1900° C., with an oxidization means containing free oxygen, with the gasification temperature lying so far above the melting temperature of the coal ash that the latter can be removed as a molten flow from the gasification chamber, with mixtures of coals of different degrees of coalification and thereby different reaction capabilities as well as different water content being gasified.

A development of the invention is produced by the previously characterized method in which the coals forming the mixture are pulverized into different grain bands for achieving the same rate of turnover.

A development of the invention is produced by the previously characterized method in which the grain bands are characterized by the following grain size distribution:

| Fuels | | Grain size distribution |
|---|---|---|
| Petrol coke<br>Anthracite<br>Stone coal | (low reactivity $V^{daf}$ ≦18%) | 50% < 63 μm<br>95Ma % < 200 μm |
| Pyrolysis coke | | ≧99% < 250 μm<br>98% < 500 μm |
| Stone coal | | ≧94% < 250 μm<br>98% < 500 μm |
| Hard brown coal | | ≧94% < 250 μm<br>98% < 500 μm |
| Soft brown coal | | ≧55% < 100 μm<br>≧97% < 500 μm |

A development of the invention is produced by the previously characterized method in which the coals are dried, depending on their degree of coalification, to different residual water contents, which are defined as follows:

| Fuels | | Moisture content |
|---|---|---|
| Petrol coke<br>Anthracite<br>Stone coal | (low reactivity $V^{daf}$ ≦18%) | <2 wt. % |
| Pyrolysis coke | | <2 wt. % |
| Stone coal | | <2 wt. % |
| Hard brown coal | | <8 wt. % |
| Soft brown coal | | <12 wt. % |

A development of the invention is produced by the previously characterized method in which the different sorts of coal are fed to different drying and pulverizing systems.

A development of the invention is produced by the previously characterized method in which the different sorts of coal are fed to a common drying and pulverizing system.

A development of the invention is produced by the previously characterized method in which the separately dried and pulverized sorts of coal are mixed homogeneously in a mixing system.

A development of the invention is produced by the previously characterized method in which the pulverized mixtures are put under operational pressure in pressure sluices and conveyed pneumatically as dense gas/pulverized fuel suspensions to the gasification reactor.

The invention claimed is:

1. A method for gasification of fuel in an entrained flow of a gasification reactor, comprising:

jointly gasifying a mixture of at least two different fuels with different degrees of coalification from the table shown below wherein the different fuels are fed to different drying and pulverizing systems to obtain the respective grain size distribution and moisture content specified therein;

providing a plurality of sluices for conveying the mixture to a dispensing vessel wherein the sluices are operated to enable continuous operation of the dispensing vessel; and transporting the mixture from the dispensing vessel to a gasification reactor

| Fuel | | Grain size distribution | Moisture content |
|---|---|---|---|
| Petrol coke<br>Anthracite<br>Stone coal | (low reactivity $V^{daf} \leqq 18\%$) | 50% < 63 μm<br>95Ma % < 200 μm | <2 wt. % |
| Pyrolysis coke | | ≧99% < 250 μm<br>98% < 500 μm | <2 wt. % |
| Stone coal | | ≧94% < 250 μm<br>98% < 500 μm | <2 wt. % |
| Hard brown coal | | ≧94% < 250 μm<br>98% < 500 μm | <8 wt. % |
| Soft brown coal | | ≧55% < 100 μm<br>≧97% < 500 μm | <12 wt. %. |

2. The method as claimed in claim 1, wherein the different fuels are fed to a common drying and pulverizing system.

3. The method as claimed in claim 1, wherein the different fuels are separately dried and pulverized and are mixed homogeneously in a mixing system.

4. The method as claimed in claim 1, wherein the different fuels are pulverized and mixed.

5. The method as claimed in claim 4, wherein the fuel mixture is put under an operational pressure in a pressure sluice and conveyed pneumatically as a dense gas or a pulverized fuel suspension to the gasification reactor.

6. The method as claimed in claim 1, wherein the gasification reactor is operated at a pressure between normal pressure and 8 MPa and at a temperature between 1200-1900° C.

7. The method as claimed in claim 6, wherein the gasified mixture of the different fuels is free of oxygen.

8. The method as claimed in claim 7, wherein a gasification temperature is above a melting temperature of an ash.

9. The method as claimed in claim 8, wherein the ash is removed as a molten flow from the gasification reactor.

* * * * *